US006137425A

United States Patent [19]

Oster et al.

[11] Patent Number: 6,137,425

[45] Date of Patent: Oct. 24, 2000

[54] WAITING TIME PREDICTION SYSTEM

[75] Inventors: Martin Oster, Königsbrunn; Peter Weisbier, Vienna; Günter Schiehser, Vienna; Werner Dziedzioch, Vienna; Kurt Eigner, Vienna; Wolfgang Grande, Vienna, all of Austria; Guenter Junge, Sachsenheim, Germany

[73] Assignee: Alcatel, Paris, France

[21] Appl. No.: 09/199,111

[22] Filed: Nov. 24, 1998

[30] Foreign Application Priority Data

Nov. 27, 1997 [DE] Germany ..... 197 52 458

[51] Int. Cl.[7] ..... G08G 1/123

[52] U.S. Cl. ..... 340/994; 340/992; 701/213; 701/216

[58] Field of Search ..... 340/994, 988, 340/989, 992; 364/142, 143, 144; 701/200, 204, 213, 216

[56] References Cited

U.S. PATENT DOCUMENTS

| | | | |
|---|---|---|---|
| 5,400,020 | 3/1995 | Jones et al. | 340/994 |
| 5,461,374 | 10/1995 | Lewiner et al. | 340/994 |
| 5,483,234 | 1/1996 | Carreel et al. | 340/994 |
| 5,504,491 | 4/1996 | Chapman | 342/357 |
| 5,541,845 | 7/1996 | Klein | 364/449 |
| 5,613,216 | 3/1997 | Galler | 455/66 |
| 5,623,260 | 4/1997 | Jones | 340/994 |
| 5,724,243 | 3/1998 | Westerlage et al. | 364/446 |
| 5,736,940 | 4/1998 | Burgener | 340/994 |
| 5,739,774 | 4/1998 | Olandesi | 340/994 |
| 5,808,565 | 9/1998 | Matta et al. | 340/994 |
| 5,987,377 | 11/1999 | Westerlage et al. | 701/204 |
| 6,006,159 | 12/1999 | Schmier et al. | 701/200 |

FOREIGN PATENT DOCUMENTS

| | | |
|---|---|---|
| 4326237 | 12/1994 | Germany . |
| 2178210 | 2/1987 | United Kingdom . |

*Primary Examiner*—Jeffery A. Hofsass
*Assistant Examiner*—Toan Pham
*Attorney, Agent, or Firm*—Ware, Fressola, Van Der Sluys & Adolphson LLP

[57] ABSTRACT

The invention relates to a waiting time prediction system for visualizing waiting times until the arrival of at least one vehicle (2), in particular a vehicle of the public transit system, at at least one station stop (5). Hardware and/or software expenses are minimized by including the following components: a first device for determining position data of the vehicle (2), a second device for calculating the remaining expected driving time until the arrival of the vehicle (2) at the station stop (5) based on the measured position data of the vehicle (2) and the known coordinates of the station stop (5), and first and second transmission means for transmitting information from the first device to the second device and from the second device to a station stop display (4), wherein the station stop display (4) can be controlled by this second transmission means to indicate the waiting time.

10 Claims, 1 Drawing Sheet

WAITING TIME PREDICTION SYSTEM

TECHNICAL FIELD

The invention relates to a waiting time prediction system for visualizing waiting times until the arrival of at least one vehicle, in particular a vehicle of the public transit system, at at least one station stop.

BACKGROUND OF THE INVENTION

The basis for indicating the waiting time at a station stop until the arrival of the next vehicle, in particular of a bus or a streetcar of the public transit system, is typically the instantaneous distance of the vehicle from the station stop. However, the actual driving times of vehicles that moved from this position to the station stop can also be taken into consideration. A rider of the transit system would then have a realistic idea about the waiting time until the next vehicle arrives, even in the event of a traffic congestion. Conventional waiting time prediction systems have so far been integrated into a RBL system (Computerized Operation Guide System). Such RBL systems are rather complex and expensive multi-component systems.

SUMMARY OF THE INVENTION

It is the object of the invention to provide a waiting time prediction system of this type that includes a minimum of hardware and software.

The object of the invention is solved by a waiting time prediction system for visualizing waiting times until the arrival of at least one vehicle, in particular a vehicle of the public transit system, at at least one station stop, having a first device for determining position data of the vehicle, a second device for calculating the remaining expected driving time until arrival of the vehicle at the station stop based on the measured position data of the vehicle and the known coordinates of the station stop, and first and second transmission means for transmitting information from the first device to the second device and from the second device to a station stop display, wherein the station stop display can be controlled by this second transmission means to indicate the waiting time. The solution is based on the general concept that typically the position of the vehicles has to be determined only once, that a computer then estimates the driving time from this position to the station stop and that information transmission means are required from the vehicle to the computer and from the computer to the display at the station stop. This greatly reduces the number of the necessary components. The proposed overall solution also features an excellent price/efficiency ratio as well as short installation and start-up times. In comparison to the RBL system, hardware and software components are much less expensive.

The first device for determining position data can include radio link means, in particular position beacons. The position of the vehicles can thereby be determined in a simple and inexpensive manner. In order to prevent the distances between the measurement points from becoming too great, a very dense network of radio beacons is required.

Widely used for determining the position is a GPS (Global Positioning System) receiver placed in the vehicle. Determination of the position via satellites is particularly advantageous because it is independent of other measurement devices and can measure data continuously. Interruptions of the measurement process, however, have to be accepted for route segments where the GPS signal is obscured, in particular inside tunnels and under underpasses. In such situations, other systems, for example odometric measurement techniques that measure wheel revolutions, can be used in combination with the GPS system.

The accuracy of the position determination can advantageously be improved further by employing a DGPS (Differential Global Positioning System). In this system, a reference receiver is located at a stationary central location. Because the reference receiver is located at a known location, it can be used as a comparison standard for all vehicles on the road. The GPS data measured in the vehicle are compared with the GPS data of the reference receiver, thereby providing a correction value applied to the measured vehicle data.

Besides the first device for determining the position data of the vehicle, a second device is required to predict the waiting time and to compute the projected remaining driving time until the vehicle arrives at the station stop. This second device need only be able to form a difference and can be placed in the vehicle. The second device, however, must include transmission means capable of transmitting the calculated remaining driving time to the next station(s).

The second device is preferably located at a central location from where a reliable radio link can be established for the individual station stops.

The two embodiments—a second device in the vehicle or a second device at the center location—may include, aside from a prediction of the waiting time intended for the rider at the next station stop, a computation of the on-time performance which is indicated to the driver. A deviation from the schedule, i.e. an early or late arrival of the vehicle, is determined through direct comparison of the measured position data with the scheduled position data at the current time. The measured difference can be displayed permanently, for example via an analog display using an array of segmented LEDs. Depending on the magnitude of the generated difference signal, a greater or smaller number of the LED segments are addressed, i.e. supplied with current.

The system is further improved by an external read-only monitoring station that provides, for example, remote diagnostics of a malfunction.

BRIEF DESCRIPTION OF THE DRAWING

The invention will be now described in greater detail with reference to an illustrated embodiments as set forth in the enclosed block diagram/diagrammatic FIGURE.

BEST MODE FOR CARRYING OUT THE INVENTION

Figure 1:
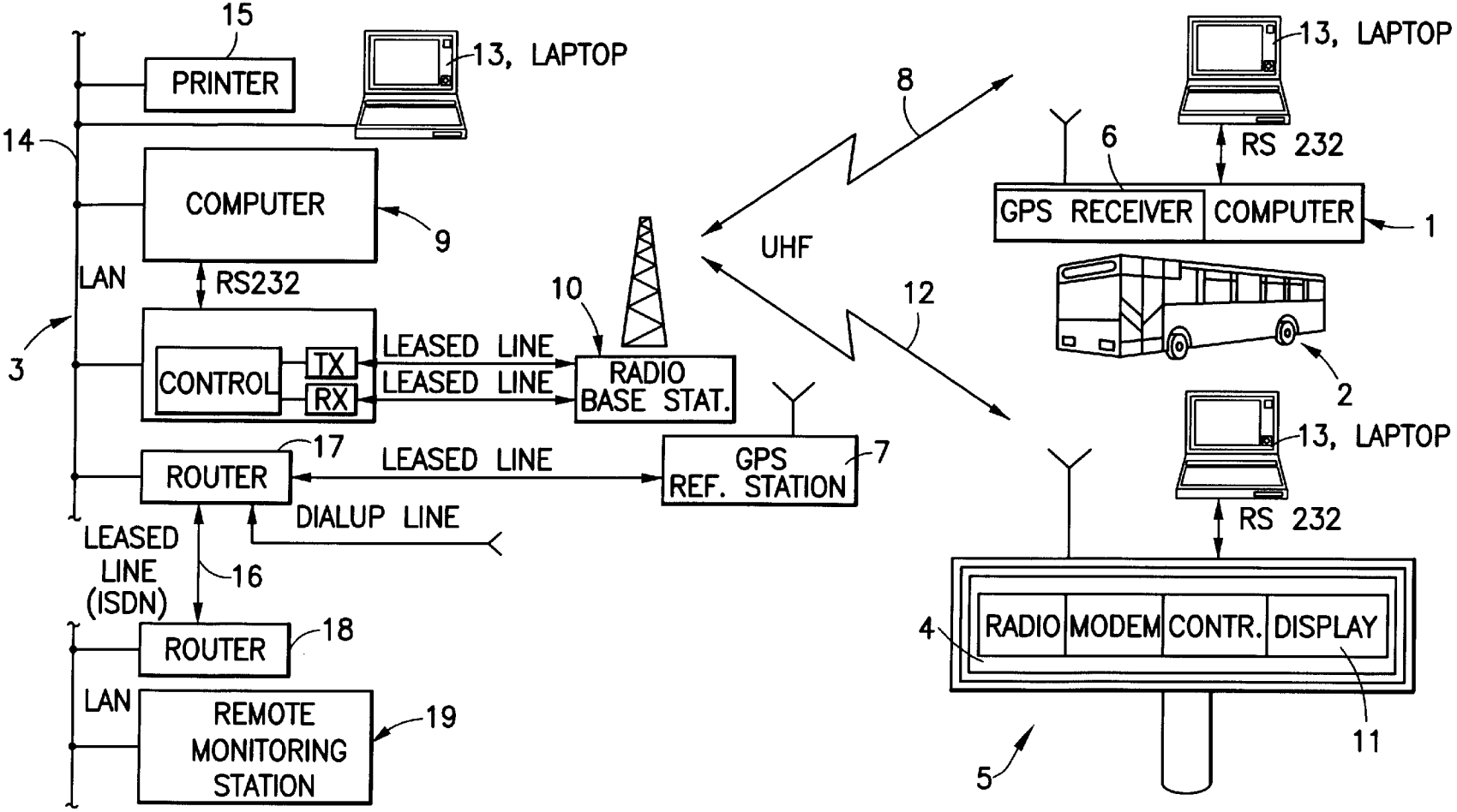

A waiting time prediction system with basically three components is illustrated, the system including an on-board computer 1 in a vehicle 2, a central location 3 and a station stop display 4 located at a station stop 5 (these are typically multiple station stops each with an associated station stop display). The on-board computer 1 has a GPS (Global Positioning System) receiver 6. To obtain extremely precise positioning data, the central location includes a GPS reference receiver 7. The GPS data are transmitted from the vehicle 2 via radio link 8 to the central location 3 where the GPS data are adjusted depending on the data determined by the GPS reference receiver 7. The GPS data then form corrected position data and are retransmitted via the radio link 8 to the vehicle 2. The central location 3 is equipped with a computer 9, for example a workstation. The computer 9 determines from the position data of the vehicle 2 and the known coordinates of the displays 4 at the individual station stops the remaining driving time until the arrival of vehicle 2 at the respective stations 5. Taken into consideration are in particular also traffic congestion and other traffic situations. This can be accomplished by determining a trend in the driving time on the respective route based on actual driving times of the vehicles that most recently traveled the same route. A radio station 10 at the central location 3 transmits the results to the display 4 at the station stop, with the display 4 including indicator means 11 capable of being controlled by the radio signal 12. The indicator means 11 can be designed, for example, as a digital display to display the remaining driving time, i.e. the waiting time, in minutes.

The central location 3 is preferably equipped with an RCS (Radio Communications Server) to manage the radio traffic from the central location 3 to the vehicles 2 and the station stop displays 4. The RCS controls radio telegrams, in particular according to the VDV (Association of German Common Carriers) standard, by managing the signal timing so as to prevent collisions between the radio signals of the transmitter and receiver side.

Data, for example data relating to the schedule, for the central location 3, the on-board computer 1 and the station stop display 4 can be entered via a laptop computer 13 that can be connected as needed.

All components of the central location 3, including a printer 15, can be connected to and communicate with each other via a data bus 14. In addition, a connection via ISDN 16 or the Internet can be established between a "router" 17 at the central location 3 and a "router" 18 at a remote monitoring station 19. This monitoring station 19 which is limited to read-only functions, allows, for example, remote error diagnostics.

The invention is not limited to the aforedescribed embodiment. A number of modifications can be considered that utilize the described features of the invention, but in different embodiments.

What is claimed is:

1. A waiting time prediction system for visualizing waiting times until the arrival of at least one vehicle (2), in particular a vehicle of the public transit system, at at least one station stop (5), characterized by a first device for determining position data of the vehicle (2), a second device for calculating the remaining expected driving time until arrival of the vehicle (2) at the station stop (5) based on the measured position data of the vehicle (2) and the known coordinates of the station stop (5), first and second transmission means for transmitting information from the first device to the second device and from the second device to a station stop display (4), wherein the station stop display (4) can be controlled by the second transmission means to indicate the waiting time, and an external read-only monitoring station (19) connected to a center location (3) via ISDN (16) or via the Internet for monitoring purposes, including remote malfunction diagnostics.

2. A waiting time prediction system according to claim 1, characterized in that the first device comprises radio means, in particular position beacons.

3. A waiting time prediction system according to claim 1, characterized in that the first device is a GPS (Global Positioning System) located in the vehicle (2).

4. A waiting time prediction system according to claim 1, characterized in that the first device is a DGPS (Differential Global Positioning System), wherein one GPS receiver (6) is located in the vehicle (2) and a GPS reference receiver (7) is located at a stationary central location (3).

5. A waiting time prediction system according to claim 4, characterized in that the second device is located in the vehicle (2).

6. A waiting time prediction system according to claim 5, characterized in that means are provided for comparing the measured position data with scheduled position data and signaling means for displaying the comparison results on a driver console that is displayed to the driver of the vehicle (2).

7. A waiting time prediction system according to claim 4, characterized in that the second device is located at a central location (3).

8. A waiting time prediction system according to claim 7, characterized in that means are provided for comparing the measured position data with scheduled position data and signaling means for displaying the comparison results on a driver console that is displayed to the driver of the vehicle (2).

9. A waiting time prediction system according to claim 1, characterized in that the second device is located in the vehicle (2).

10. A waiting time prediction system according to claim 1, characterized in that the second device is located at a central location (3).

* * * * *